US010565919B2

(12) United States Patent
Tan

(10) Patent No.: US 10,565,919 B2
(45) Date of Patent: Feb. 18, 2020

(54) METHOD AND DEVICE FOR CORRECTING COLOR CAST OF DISPLAY PANEL

(71) Applicant: BOE TECHNOLOGY GROUP CO., LTD., Beijing (CN)

(72) Inventor: Wenjing Tan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/978,940

(22) Filed: May 14, 2018

(65) Prior Publication Data

US 2019/0066564 A1 Feb. 28, 2019

(30) Foreign Application Priority Data

Aug. 24, 2017 (CN) ..... 2017 1 0734994

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2310/0232* (2013.01); *G09G 2320/0242* (2013.01); *G09G 2360/145* (2013.01); *G09G 2380/02* (2013.01)

(58) Field of Classification Search
CPC .... G09G 2380/02; G09G 3/2003; G09G 3/30; G09G 2320/0242; G09G 2320/0626; G09G 2320/0666; G06F 1/1652
See application file for complete search history.

(56) References Cited

U.S. PATENT DOCUMENTS

| | | | | |
|---|---|---|---|---|
| 9,874,786 | B2 * | 1/2018 | Zhao | G02F 1/133305 |
| 2006/0109391 | A1 * | 5/2006 | Huitema | G09G 3/3611 349/19 |
| 2015/0301672 | A1 * | 10/2015 | Kim | G09G 3/20 345/156 |
| 2016/0231850 | A1 * | 8/2016 | Choi | G06F 3/0416 |
| 2017/0316738 | A1 * | 11/2017 | Sohn | G09G 3/3225 |
| 2019/0051230 | A1 * | 2/2019 | Jeon | G09G 3/3233 |

* cited by examiner

*Primary Examiner* — Antonio A Caschera
(74) *Attorney, Agent, or Firm* — Leason Ellis LLP

(57) ABSTRACT

Embodiments of the present disclosure disclose a method for correcting color cast of a display panel and a device for the same. The method for correcting color cast includes: measuring a pressure of a bending area and a distance from a central point of the at least one bending area to a central point of a flat area; determining corresponding color cast value of the at least one bending area according to a pre-stored color cast correction model, the pressure and the distance; and determining the color correction amount according to the color cast value, and correcting the color cast of the at least one bending area.

8 Claims, 4 Drawing Sheets

METHOD AND DEVICE FOR CORRECTING COLOR CAST OF DISPLAY PANEL

CROSS REFERENCE TO RELATED APPLICATION

The application claims priority to the Chinese patent application No. 201710734994.3, filed Aug. 24, 2017, the disclosure of which is incorporated herein by reference as part of the application.

TECHNICAL FIELD

Embodiments of the present disclosure relate to a method for correcting color cast of a display panel and a device for the same.

BACKGROUND

In recent years, with the advance of display technology, organic light-emitting diode (OLED) display has become one of the hot topics in the field of flat panel display (FPD). More and more active matrix organic light-emitting diode (AMOLED) display panels enter the market. Compared with the traditional thin-film transistor liquid crystal display (TFT-LCD) panel, AMOLED has rapider response speed, higher contrast and wider viewing angle. Moreover, along with the development of the display technology, more and more electronic devices begin to use thinner and lighter flexible OLED displays with good impact resistance.

The OLED display mainly realizes image display by adopting current to drive OLED devices to emit light. Due to the factors such as the structural characteristics of the OLED devices and the manufacturing process of the display, the display will easily cause color cast in a large field of view. Particularly as for a bending area obtained after the bending of the display, the color cast phenomenon will be more obvious, severely affecting the display effect of the display.

SUMMARY

Embodiments of the disclosure provides a method for correcting color cast of a display panel and a device for the same, in order to solve the problem of color cast in bending areas of a flexible display panel.

In first aspect of the disclosure, there is provided a method for correcting color cast of a display panel, wherein the display panel comprises a flat area and at least one bending area, and the method comprises: measuring a pressure of the at least one bending area and a distance from a central point of the at least one bending area to a central point of the flat area; determining color cast value of the at least one bending area according to a pre-stored color cast correction model, the pressure and the distance, wherein the color cast correction model comprises corresponding relationships between the color cast value, the pressure and the distance; and determining color correction amount according to the color cast value, and correcting the color cast of the at least one bending area.

In second aspect of the disclosure, there is provided a device for correcting color cast of a display panel, wherein the display panel comprises a flat area and at least one bending area; and the device for correcting color cast comprises: a measuring circuit, a determining circuit and a correcting circuit, wherein the measuring circuit is configured to measure a pressure of the at least one bending area and a distance from a central point of the at least one bending area to a central point of the flat area; the determining circuit is configured to determine color cast value of the at least one bending area according to a pre-stored color cast correction model, the pressure and the distance, wherein the color cast correction model comprises corresponding relationships between the color cast value, the pressure and the distance; and the correcting circuit is configured to determine color correction amount according to the color cast value and correct the color cast of the at least one bending area.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
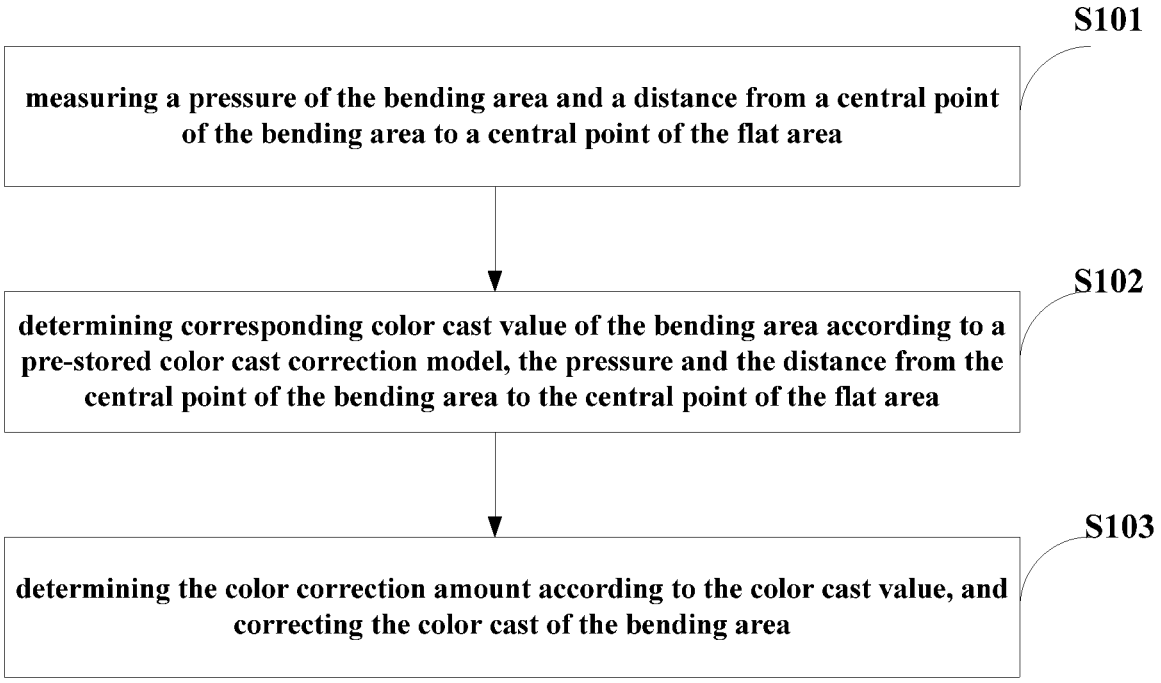
FIG. 1 is a flow chart of a method for correcting color cast of a display panel provided by an embodiment of the present disclosure.

An embodiment of the present disclosure provides a method for correcting color cast of a display panel. The display panel includes a flat area and at least one bending area. As illustrated in FIG. 1, the method for correcting color cast may comprise:

S101: measuring a pressure of the bending area and a distance from a central point of the bending area to a central point of the flat area;

S102: determining corresponding color cast value of the bending area according to a pre-stored color cast correction model, the pressure and the distance from the central point of the bending area to the central point of the flat area.

For example, the color cast correction model includes corresponding relationships between the color cast value, the pressure and the distance from the central point of the bending area to the central point of the flat area; and S103: determining the color correction amount according to the color cast value, and correcting the color cast of the bending area.

In the method for correcting color cast provided by the embodiment of the present disclosure, the real-time correction of the color cast of the bending area in the flexible display panel is realized by measuring the pressure of the bending area of the display panel, acquiring the color cast value of the bending area of the display panel according to the pre-stored color cast correction model, and correcting the color component of corresponding bending area according to the color cast value.

For instance, the method for correcting color cast of a display panel provided by the embodiment of the present disclosure may further comprise: establishing the color cast correction model and storing the color cast correction model into the display panel. For instance, in order to realize the real-time correction of the color cast of the bending area in the display panel, the color cast correction model may be established in advance and stored into the display panel. Thus, in actual application, corresponding color cast value may be acquired according to the color cast correction model as long as the pressure of the bending area of the display panel is measured, and then the color correction amount corresponding to the color cast value may be calculated and used for the real-time color cast correction of the bending area.

For instance, in the method for correcting color cast of a display panel provided by the embodiment of the present disclosure, the step of establishing the color cast correction model may include: selecting a plurality of display panels, bending the display panels according to different curvature radiuses, thus, the display panels each including sample bending area and sample flat area are formed; establishing corresponding relationships between the color cast value of the sample bending area, the curvature radius and the distance; and establishing corresponding relationship between the pressure of the sample bending area and the curvature radius. For instance, in the method for correcting color cast provided by the embodiment of the present disclosure, the color cast correction model includes the corresponding relationship between the pressure and the curvature radius, and the corresponding relationship between the color cast value, the curvature radius and the distance. Therefore, the creation of the color cast correction model includes the creation of the corresponding relationship between the color cast value, the curvature radius and the distance, and the corresponding relationship between the pressure of the bending area and the curvature radius. Thus, in actual application, corresponding color cast value can be acquired by detecting the pressure of the bending area, and the color correction amount corresponding to the color cast value can be calculated, and finally the color cast correction is realized.

Figure 2:
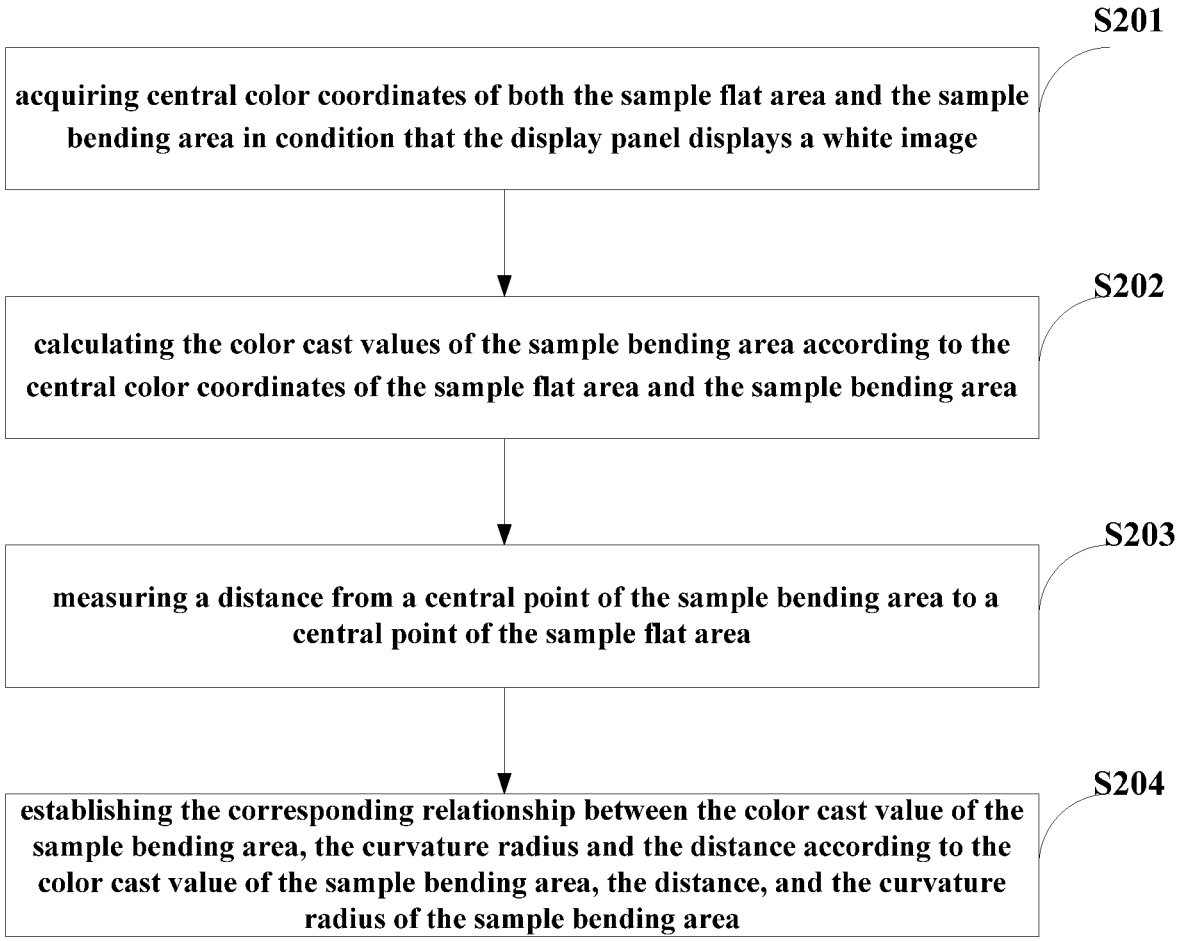
FIG. 2 is a flow chart illustrating a process of establishing a color cast correction model in an embodiment of the present disclosure.

For instance, in the method for correcting color cast provided by the embodiment of the present disclosure, as illustrated in FIG. 2, the step of establishing the corresponding relationships between the color cast value of the sample bending area, the curvature radius and the distance may include:

S201: acquiring central color coordinates of both the sample flat area and the sample bending area in condition that the display panel displays a white image;

S202: calculating the color cast values of the sample bending area according to the central color coordinates of the sample flat area and the sample bending area;

S203: measuring a distance from a central point of the sample bending area to a central point of the sample flat area; and S204: establishing the corresponding relationship between the color cast value of the sample bending area, the curvature radius and the distance according to the color cast value of the sample bending area, the distance, and the curvature radius of the sample bending area.

Figure 3:
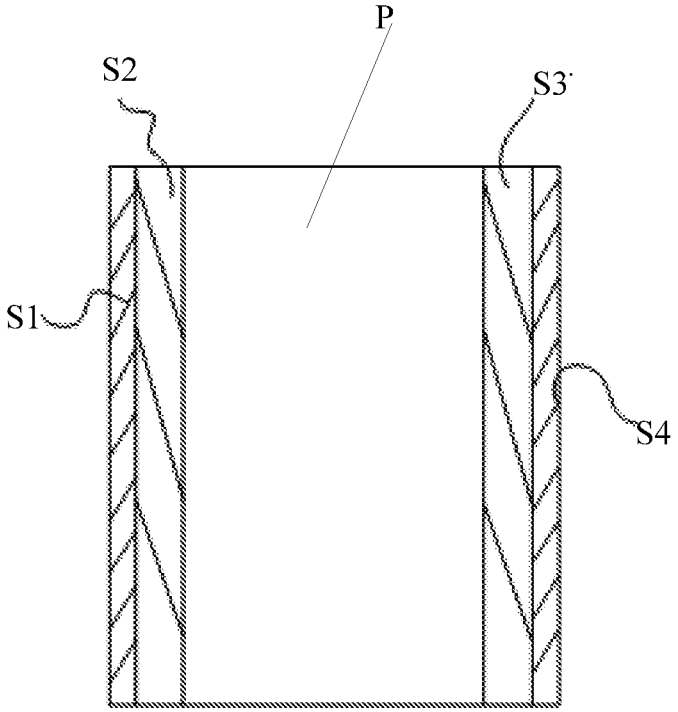
FIG. 3 is a schematic structural view illustrating a bending state of a display panel in an embodiment of the present disclosure.

For instance, in the method for correcting color cast provided by the embodiment of the present disclosure, the display brightness when the display panel displays the white image may be measured, and then the display panel may be divided into a flat area and at least one bending area according to the display brightness. As illustrated in FIG. 3, two edges of the display panel are bent to form a flat area P in the middle and four bending areas S1 to S4, among them, S1 and S4 may be set to be symmetrically distributed, and S2 and S3 may be set to be symmetrically distributed. In actual application, the number of the divided bending areas of the display panel may be more or less according to the production demands of actual products, which is not limited here. Depending on different modes the display panel is bent, the bending areas with different curvature radiuses may be obtained. When the display panel displays the white image, color coordinates of central point of each area may be acquired by a camera, e.g., a CCD camera; and the color cast value of each bending area may be calculated with reference to the color coordinate of the central point of the flat area. Then, the corresponding relationships between the color cast value, the curvature radius and the distance under a certain bending mode may be created by measuring and calculating the distance from the central point of each bending area to the central point of the flat area. The corresponding relationships between the color cast value, the curvature radius and the distance under several bending modes of the display panel may be established by changing the bending mode of the display panel, namely forming the bending areas with different curvature radiuses, and repeating the above operations. Then, the relationships between color cast $\Delta uv$ (which is from a central point of the display panel to the bending area), the curvature radius R and the horizontal shift X (the distance from the central point of the display panel to the central point of each bending area) may be obtained: $\Delta uv=f1(R, X)$.

Figure 4:
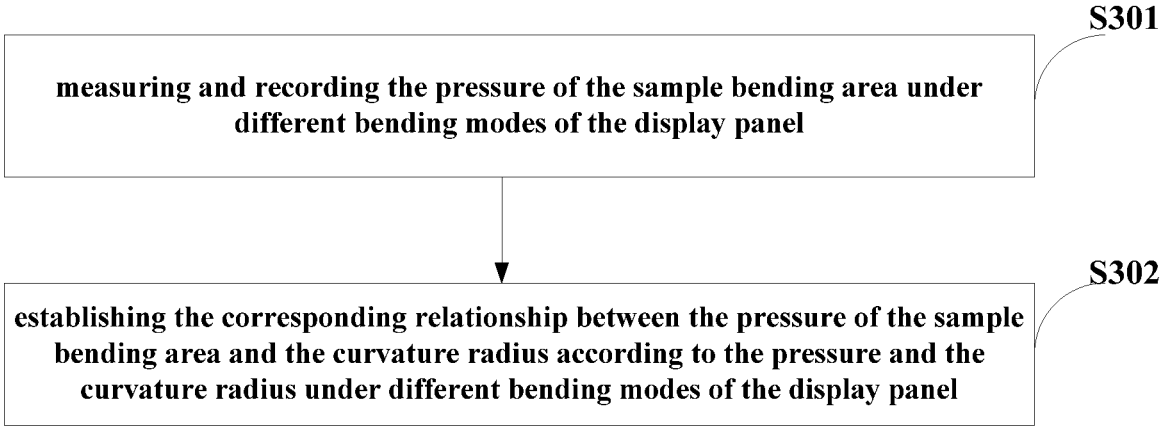
FIG. 4 is a flow chart illustrating a process of establishing a color cast correction model in another embodiment of the present disclosure.

For instance, in the method for correcting color cast provided by the embodiment of the present disclosure, as illustrated in FIG. 4, the step of establishing the corresponding relationship between the pressure of the sample bending area and the curvature radius may include:

S301: measuring and recording the pressure of the sample bending area under different bending modes of the display panel; and S302: establishing the corresponding relationship between the pressure of the sample bending area and the curvature radius according to the pressure and the curvature radius under different bending modes of the display panel.

Figure 5:
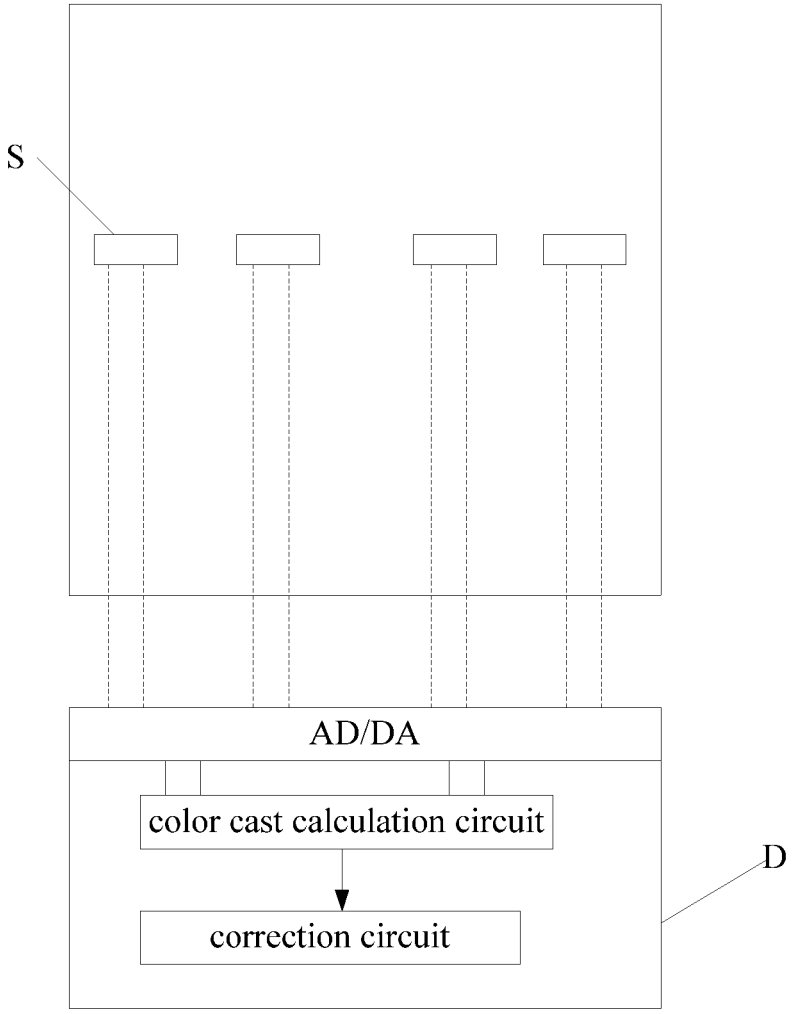
FIG. 5 is a schematic structural view of a display panel in an embodiment of the present disclosure.

For instance, in the method for correcting color cast provided by the embodiment of the present disclosure, a pressure sensor may be adopted to measure the pressure of the bending area. As illustrated in FIG. 5, a plurality of pressure sensors S used for measuring pressure are disposed on the backside of the display panel. By using the plurality of pressure sensors are attached to the rear of a screen of the display panel, the pressure values under different curvature radiuses may be measured, and the mapping relationship between the pressure value F and the curvature radius R may be calculated, namely, R=f2(F).

Figure 6:
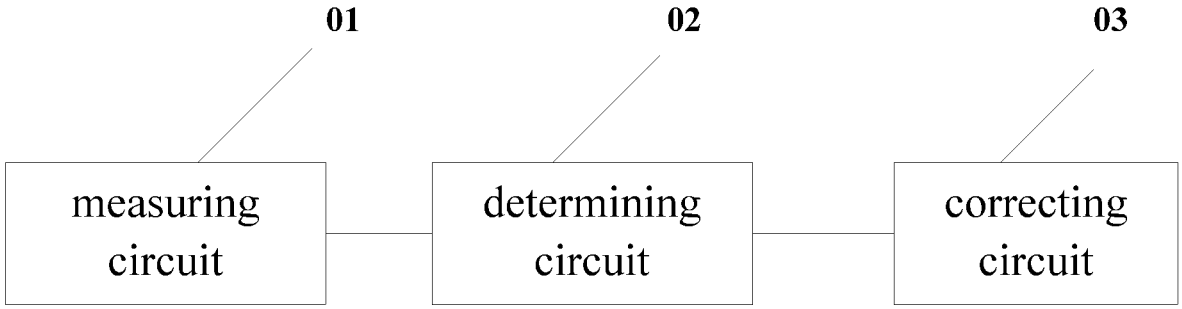
FIG. 6 is a schematic structural view of a device for correcting color cast of a display panel provided by an embodiment of the present disclosure.

The embodiment of the present disclosure provides a device for correcting color cast of a display panel. The display panel includes a flat area and at least one bending area. As illustrated in FIG. 6, the device for correcting color cast may comprise: a measuring circuit 01, a determining circuit 02 and a correcting circuit 03, wherein, the measuring circuit 01 is configured to measure a pressure of the bending area and a distance from the central point of the bending area to the central point of the flat area;

the determining circuit 02 is configured to determine the color cast value of the bending area according to a pre-stored color cast correction model, the pressure and the distance, in which the color cast correction model includes corresponding relationships between the color cast value, the pressure and the distance; and the correcting circuit 03 is configured to determine the color correction amount according to the color cast value and correct the color cast of the bending area.

In the device for correcting color cast provided by the embodiment of the present disclosure, the real-time correction of the color cast of the bending area of the flexible display panel is realized by adopting the measuring circuit to measure the pressure of the bending area of the display panel, adopting the determining circuit to determine the color cast value of the bending area of the display panel according to the pre-stored color cast correction model, and adopting the correcting circuit to correct the color component of bending area according to the color cast value. It should be noted that in actual application, the established color cast correction model may be integrated into a driving chip of the display panel. As illustrated in FIG. 5, an AD/DA port of a driving chip D acquires information of pressure sensors in real time and transmits the information to a color cast calculation circuit (including a first determination circuit and a second determination circuit), so as to calculate the color cast values of the bending areas; the correcting circuit acquires the color correction amount of the bending area according to the color cast value; and finally the color cast correction of the bending area is realized.

For instance, the determining circuit 02 is a transistor circuit of an integrated chip (IC) for realizing the foregoing functions. In the IC design period, the transistor circuit is generated by IC manufacturing process after programming according to the model and the calculation formula provided by the present disclosure.

For instance, the device for correcting color cast provided by the embodiment of the present disclosure may further comprise: a establishing circuit. The establishing circuit is configured to establish the color cast correction model and store the color cast correction model into the display panel. For instance, data obtained by the measuring circuit are subjected to statistics, analysis and fitting. For instance, several display panels may be selected; the display panels may be bent in different curvature radiuses; and display panels provided with sample bending areas and sample flat areas are formed. In the device for correcting color cast provided by the embodiment of the present disclosure, the establishing circuit may include: a first establishing sub-circuit and a second establishing sub-circuit, in which the first establishing sub-circuit is configured to establish the corresponding relationships between the color cast value of the sample bending area, the curvature radius and the distance, and the second establishing sub-circuit is configured to establish the corresponding relationship between the pressure of the sample bending area and the curvature radius. For instance, in the device for correcting color cast provided by the embodiment of the present disclosure, the first establishing sub-circuit is specifically configured to establish the corresponding relationships between the color cast value of the bending area, the curvature radius and the distance, and the second establishing sub-circuit is specifically configured to establish the corresponding relationship between the pressure of the bending area and the curvature radius. The specific process of establishing the corresponding relationships is as described above. No further description will be given here.

For instance, in the device for correcting color cast provided by the embodiment of the present disclosure, the measuring circuit may include: a pressure sensor. The pressure sensor is configured to measure the pressure of the bending area. A plurality of pressure sensors are disposed on the backside of the display panel.

For instance, the device for correcting color cast provided by the embodiment of the present disclosure may further comprise: a dividing circuit. The dividing circuit is configured to measure the display brightness when the display panel displays a white image, and divide the display panel into the flat area and the at least one bending area according to the display brightness. For instance, the dividing circuit includes a CCD camera and is configured to detect the full-screen brightness in the case of displaying white image. The dividing circuit may further include analysis software, in order to divide the screen into a flat area and at least one bending area by taking the brightness of a central area as reference of detected brightness and taking the brightness threshold and the brightness declining brightness value input by the user as judgment basis.

The embodiment of the present disclosure provides a method for correcting color cast of a display panel and a device for the same, wherein the display panel includes a flat area and at least one bending area. The method comprises: measuring a pressure of the bending area and a distance from the central point of the bending area to the central point of the flat area; determining corresponding color cast value of the bending area according to a pre-stored color cast correction model, the pressure and the distance, in which the color cast correction model includes corresponding relationships between the color cast value, the pressure and the distance; and determining the color correction amount according to the color cast value, and correcting the color cast of the bending area. Thus, the real-time correction of the color cast of the bending area of the flexible display panel can be realized by measuring the pressure of the bending area of the display panel, acquiring the color cast value of the bending area of the display panel according to the pre-stored color cast correction model, and correcting the color component of corresponding bending area according to the color cast value.

Those skilled in the art shall understand that the embodiments of the disclosure are able to be provided as a method, a system or a computer program product. Therefore, the disclosure can adopt forms of a complete hardware embodiment, a complete software embodiment or embodiment combining software and hardware. In addition, the disclosure can adopt the form of computer program product that is implemented on one or more computer applicable storage mediums (comprising, but not limited, disk memory, CD-ROM, optical memory, etc.) comprising computer applicable program codes therein.

The disclosure is described herein with reference to flowchart charts and/or block diagrams of methods, apparatuses (systems), and computer program products according to the embodiments of the disclosure. It should be understood that each flow and/or block in the flowchart and/or block diagram, and a combination of flow and/or block in the flowchart and/or block diagram can be implemented by computer program instructions. These computer program instructions may be provided to a general purpose computer, a special purpose computer, an embedded processor or a processor of other programmable data processing apparatus to form a machine, such that devices for implementing functions specified by one or more flows in the flowchart and/or one or more blocks in the block diagram may be generated by executing the instructions with the processor of the computer or other programmable data processing apparatus.

These computer program instructions may also be stored in a computer-readable memory that can direct the computer or other programmable data processing apparatus to operate in a given manner, so that the instructions stored in the computer-readable memory produce a manufactured article comprising an instruction device, and the instruction device implements the functions specified by one or more flows in the flowchart and/or one or more blocks in the block diagram.

These computer program instructions may also be loaded onto the computer or other programmable data processing apparatus, such that a series of process steps may be executed on the computer or other programmable data processing apparatus to produce process implemented by the computer, thereby, the instructions executed on the computer or other programmable data processing apparatus provide steps of implementing the functions specified by one or more flows in the flowchart and/or one or more blocks in the block diagram.

What is described above is related to the illustrative embodiments of the disclosure only and not limitative to the scope of the disclosure; the scopes of the disclosure are defined by the accompanying claims.

The invention claimed is:

1. A method for correcting color cast of a display panel, wherein the display panel comprises a flat area and at least one bending area, and the method comprises:

establishing a color cast correction model and storing the color cast correction model into the display panel;

measuring a pressure of the at least one bending area and a distance from a central point of the at least one bending area to a central point of the flat area;

determining color cast value of the at least one bending area according to the stored color cast correction model, the pressure and the distance, wherein the color cast correction model comprises corresponding relationships between the color cast value, the pressure and the distance; and determining color correction amount according to the color cast value, and correcting the color cast of the at least one bending area, wherein the establishing the color cast correction model comprises:

selecting several display panels, bending the several display panels according to different curvature radiuses, such that each display panel is provided with a sample bending area and a sample flat area;

establishing corresponding relationship between color cast value of the sample bending area, the curvature radius and the distance; and establishing corresponding relationship between pressure of the sample bending area and the curvature radius.

2. The method for correcting color cast according to claim 1, wherein the establishing the corresponding relationship between the color cast value of the sample bending area, the curvature radius and the distance comprises:

acquiring central color coordinates of both the sample flat area and the sample bending area in condition that the display panel displays a white image;

calculating color cast value of the sample bending area according to the central color coordinates of the sample flat area and the sample bending area;

measuring a distance from a central point of the sample bending area to a central point of the sample flat area; and establishing the corresponding relationship between the color cast value of the sample bending area, the curvature radius and the distance according to the color cast value of the sample bending area, the distance, and the curvature radius of the sample bending area.

3. The method for correcting color cast according to claim 1, wherein the establishing the corresponding relationship between the pressure of the sample bending area and the curvature radius comprises:

measuring and recording pressure of the sample bending area under different bending modes of the display panel; and establishing the corresponding relationship between the pressure of the sample bending area and the curvature radius according to the pressure and the curvature radius of the display panel under different bending modes.

4. The method for correcting color cast according to claim 1, wherein the measuring the pressure of the at least one bending area comprises:

measuring the pressure of the at least one bending area by using a pressure sensor, wherein a plurality of pressure sensors for measuring pressure are disposed on a backside of the display panel.

5. The method for correcting color cast according to claim 1, further comprising:

measuring display brightness in condition that the display panel displays a white image; and dividing the display panel into a flat area and at least one bending area according to the display brightness.

6. A device for correcting color cast of a display panel, wherein the display panel comprises a flat area and at least one bending area; and the device for correcting color cast comprises: an establishing circuit, a measuring circuit, a determining circuit and a correcting circuit, wherein:

the establishing circuit is configured to establish the color cast correction model and store the color cast correction model into the display panel;

the measuring circuit is configured to measure a pressure of the at least one bending area and a distance from a central point of the at least one bending area to a central point of the flat area;

the determining circuit is configured to determine color cast value of the at least one bending area according to the stored color cast correction model, the pressure and the distance, wherein the color cast correction model comprises corresponding relationships between the color cast value, the pressure and the distance; and the correcting circuit is configured to determine color correction amount according to the color cast value and correct the color cast of the at least one bending area, wherein the establishing circuit comprises:

a first establishing sub-circuit and a second establishing sub-circuit;

several display panels are selected; the several display panels are bent according to different curvature radiuses, such that each display panels is provided with a sample bending area and a sample flat area;

the first establishing sub-circuit is configured to establish the corresponding relationship between the color cast value of the sample bending area, the curvature radius and the distance; and the second establishing sub-circuit is configured to establish the corresponding relationship between the pressure of the sample bending area and the curvature radius.

7. The device for correcting color cast according to claim 6, further comprising a dividing circuit which is configured to measure display brightness in condition that the display panel displays a white image and divide the display panel into the flat area and the at least one bending area according to the display brightness.

8. The device for correcting color cast according to claim 6, wherein the measuring circuit comprises a pressure sensor.

* * * * *